US008275278B2

(12) United States Patent
Ishigaya et al.

(10) Patent No.: US 8,275,278 B2
(45) Date of Patent: Sep. 25, 2012

(54) FIXING CONTROL DEVICE, FIXING DEVICE, AND IMAGE FORMING APPARATUS

(75) Inventors: Yasunori Ishigaya, Yokohama (JP); Ryota Yamashina, Koganei (JP)

(73) Assignee: Ricoh Company Ltd., Tokyo (JP)

( * ) Notice: Subject to any disclaimer, the term of this patent is extended or adjusted under 35 U.S.C. 154(b) by 424 days.

(21) Appl. No.: 12/585,221

(22) Filed: Sep. 9, 2009

(65) Prior Publication Data

US 2010/0061754 A1 Mar. 11, 2010

(30) Foreign Application Priority Data

Sep. 9, 2008 (JP) ..... 2008-230888

(51) Int. Cl.
*G03G 15/20* (2006.01)

(52) U.S. Cl. ..... 399/70; 399/69

(58) Field of Classification Search ..... 399/70, 399/69, 67, 330, 334, 328, 320; 219/216
See application file for complete search history.

(56) References Cited

U.S. PATENT DOCUMENTS

| | | | | |
|---|---|---|---|---|
| 6,301,454 | B1 * | 10/2001 | Nishida et al. | 399/69 |
| 2007/0088963 | A1 * | 4/2007 | Nakaya | 713/300 |
| 2008/0253789 | A1 | 10/2008 | Yoshinaga et al. | |

FOREIGN PATENT DOCUMENTS

| | | |
|---|---|---|
| JP | 59-111669 | 6/1984 |
| JP | 06-236128 | 8/1994 |
| JP | 09-311584 | 12/1997 |
| JP | 10-186940 | 7/1998 |
| JP | 11-030929 | 2/1999 |
| JP | 2002-182521 | 6/2002 |
| JP | 2007-148349 | 6/2007 |

* cited by examiner

*Primary Examiner* — Walter L Lindsay, Jr.
*Assistant Examiner* — Billy J Lactaoen
(74) *Attorney, Agent, or Firm* — Harness, Dickey & Pierce

(57) ABSTRACT

A fixing control device includes a power distribution controller that adjusts a power distribution time period when the power is distributed to plural heater elements per control cycle, a turn on time determining member that determines a time when each of the plural heater elements is turned on based on a duty ratio between the power distribution time period and the control cycle, and a soft operation controller that either gradually starts or stops heating each of the plural heater elements during a soft start or stop period, respectively. One of the soft start and stop periods for one of the plural heater elements is decreased not to overlap with another one of the plural heater elements.

19 Claims, 10 Drawing Sheets

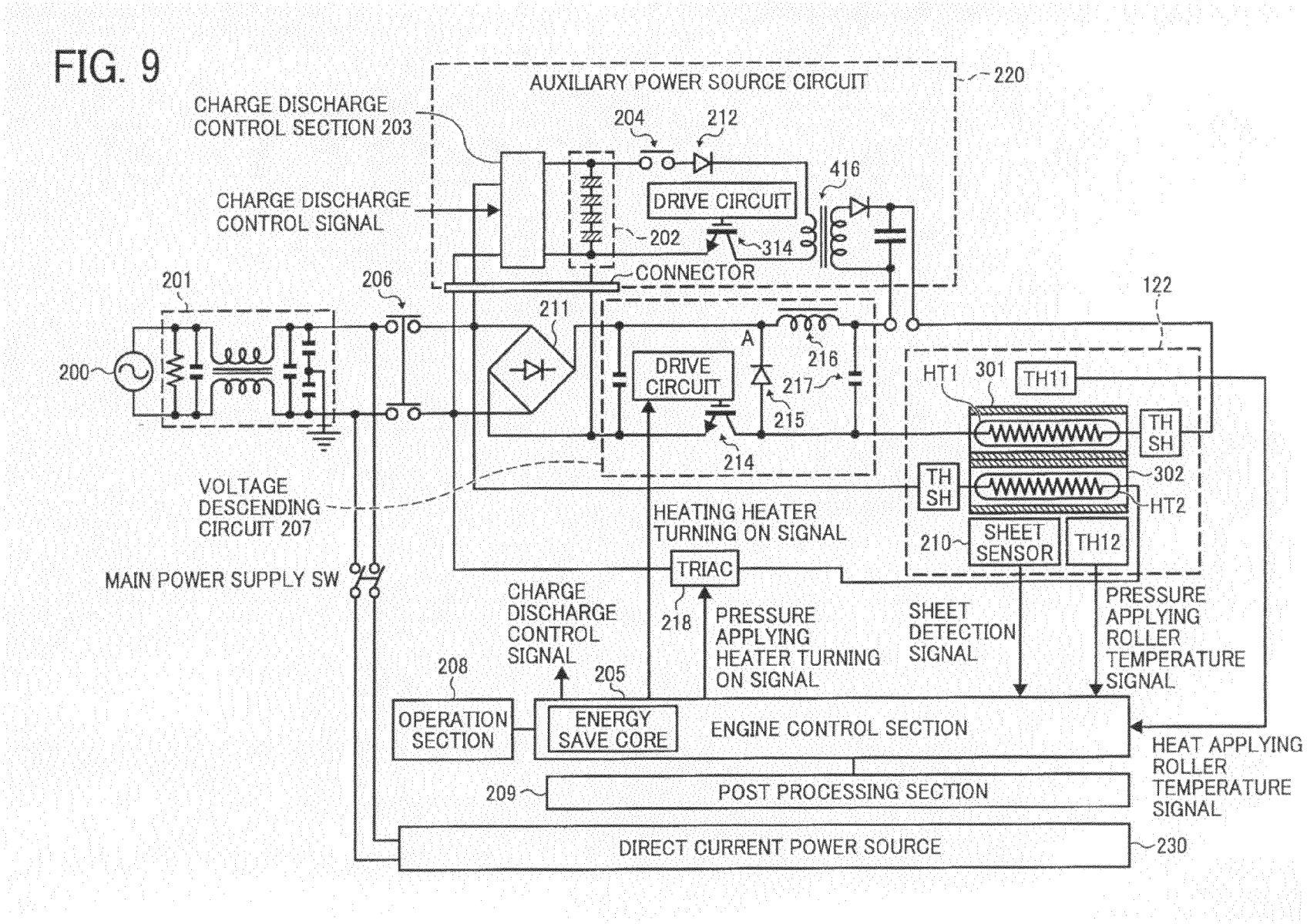
FIG. 9
AUXILIARY POWER SOURCE CIRCUIT
220
CHARGE DISCHARGE CONTROL SECTION 203
CHARGE DISCHARGE CONTROL SIGNAL
DRIVE CIRCUIT
314
416
212
204
202
CONNECTOR
DRIVE CIRCUIT
216
217
215
214
A
211
206
201
200
VOLTAGE DESCENDING CIRCUIT 207
MAIN POWER SUPPLY SW
HEATING HEATER TURNING ON SIGNAL
TRIAC
218
PRESSURE APPLYING HEATER TURNING ON SIGNAL
CHARGE DISCHARGE CONTROL SIGNAL
ENERGY SAVE CORE
205
OPERATION SECTION
208
ENGINE CONTROL SECTION
POST PROCESSING SECTION
209
DIRECT CURRENT POWER SOURCE
230
HEAT APPLYING ROLLER TEMPERATURE SIGNAL
PRESSURE APPLYING ROLLER TEMPERATURE SIGNAL
SHEET DETECTION SIGNAL
122
TH SH
302
HT2
TH12
SHEET SENSOR
210
TH SH
HT1
301
TH11

FIXING CONTROL DEVICE, FIXING DEVICE, AND IMAGE FORMING APPARATUS

CROSS REFERENCE TO RELATED APPLICATION

This application claims priority under 35 USC §119 to Japanese Patent Application No. 2008-230888, filed on Sep. 9, 2008, the entire contents of which are herein incorporated by reference

BACKGROUND OF THE INVENTION

1. Field of the Invention

The present invention relates to a fixing device for fixing a toner image by applying heat and melting a toner image onto a surface of a printing medium, a control device for controlling the fixing device, and an image forming apparatus having the fixing device 2. Discussion of the Background Art In an image forming apparatus, such as a printer, a copier, a facsimile, etc., it is well known that a toner image is fixed onto a printing medium, such as a sheet, etc., by applying heat and melting the toner image. In general, in a fixing device, power is supplied to a heater serving as a heat source so that the heater heats a fixing member, such as fixing roller, a fixing belt, etc., and thereby fixing the toner image onto the printing medium.

In such a fixing device, to maintain a fixing temperature at a prescribed level during the fixing, the heater is supplied with power and increases its temperature to a prescribed level (i.e., a target control temperature), so as to get ready for the fixing. A printing medium is then conveyed through the fixing device maintaining the fixing temperature.

Such power drive of the heater (i.e. heating control) is executed by controlling power distribution thereto. To control the power distribution to the heater, temperature is generally detected by a temperature sensor, such as a thermistor (TM), etc., arranged in the fixing device, and a power distribution time period (i.e. Duty) per hour (i.e. a control cycle) is changed in accordance with a difference between detected and target control temperatures.

As a method of calculating the Duty, feedback control, such as PID control, etc., is frequently used as mentioned below.

Specifically, PID control is executed by combining Proportional (P), Integral (I), and differential (D) processing while optimizing plural parameters in accordance with a difference between target and current values.

When fixing temperature is controlled, Duty is calculated using the formula 1 per a control cycle, wherein Kp represents proportional gain, $T_I$ represents an integral time period, $T_D$ represents a differential time period, e(t) represents a difference between temperatures of a control target and a fixing member (=r(t)−y(t)), r(t) represents target control temperature, y(t) represents temperature of a fixing member, and T represents a control cycle.

$$\text{DUTY}=Kp(e(t)+1/T_I\times\int_0^T e(t)dt+T_D\times de(t)/dt). \qquad \text{Formula 1;}$$

Since the duty is calculated based on temperature information using a PID controller, fixing temperature can be stable at around the target level as shown in FIG. 10. Specific aspect of controlling power distribution when a control cycle is 200 ms and the duty calculated by the PID controller is 30% is illustrated in FIG. 11. As shown, the power distribution is started from a zero cross point of a commercial power supply and completes at 30% of the 200 ms, specifically, when 60 ms has elapsed. Such a control manner is called an on/off system.

A lot of inrush current flows when heater starts turning on in the on/off system when a halogen heater is employed. Thus, when a commercial power supply is connected to the halogen heater, a voltage of a commercial power supply line changes, and a flicker phenomenon that adversely affects instruments connected to the power supply line occurs.

To avoid this phenomenon, a phase change control system is widely spreading as a soft start system in that a time period of power distribution to the heater gradually increases when the power distribution starts as shown in FIG. 12. In a certain condition, a soft stop system is used together for the same reason to gradually decrease the power distribution time period at the time of turning off as shown in FIG. 13.

An aspect of controlling power distribution using both of the soft start and stop systems on condition that a control cycle is 200 ms and a duty is 30% is illustrated in FIG. 14. With the above-mentioned soft start and stop systems, the flicker phenomenon can be avoided due to reduction of sharp change of the voltage. However, since a higher harmonic wave current is induced due to execution of the phase control, the soft start and stop systems need be executed by balancing countermeasures against the flicker and high harmonic wave current.

Further, the most of fixing devices employ plural heater elements to deal with various widths of sheets conveyed there through these days. In such a situation, the above-mentioned soft start and stop systems are employed in each of the plural heaters, for example two heaters as shown in FIG. 15.

However, as shown, when the plural heaters are turned on, soft start and stop time periods for these overlap each other, the higher harmonic wave current further increases as a problem.

Then, as discussed in the Japanese Patent Applications 10-186940, 6-236128, 9-311584, and 59-111669, a turning on start time for a heater is deviated from that for other's not to overlap the soft start and stop time periods with each other to effectively suppress a change of voltage and occurrence of high harmonic wave current.

However, since the duty changes at real time in accordance with temperature of a fixing member as mentioned earlier, the soft start and stop time zone sometime overlap with other's depending on a value of the duty as a problem, when the duty calculation is executed by the PID controller and each of the heater power distribution start times is simply shifted.

SUMMARY OF THE INVENTION

Accordingly, an object of the present invention is to improve such background arts technologies and provides a new and novel fixing control device. Such a new and novel fixing control device includes a power distribution controller that adjusts a power distribution time period when the power is distributed to plural heater elements per control cycle, a turn on time determining member that determines a time when each of the plural heater elements is turned on based on a duty ratio between the power distribution time period and the control cycle, and a soft operation controller that either gradually starts or stops heating each of the plural heater elements during a soft start or stop period, respectively. The soft start or stop period for one of the plural heater elements is decreased not to overlap with the soft start or stop period of the other one of the plural heater elements.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 4 is a chart typically illustrating an exemplary condition when a pair of heaters is turned on;

FIG. 9 illustrates an exemplary circuit of a power supply section and surroundings of another embodiment employing a secondary power supply device;

PREFERRED EMBODIMENTS OF THE PRESENT INVENTION

Figure 1:
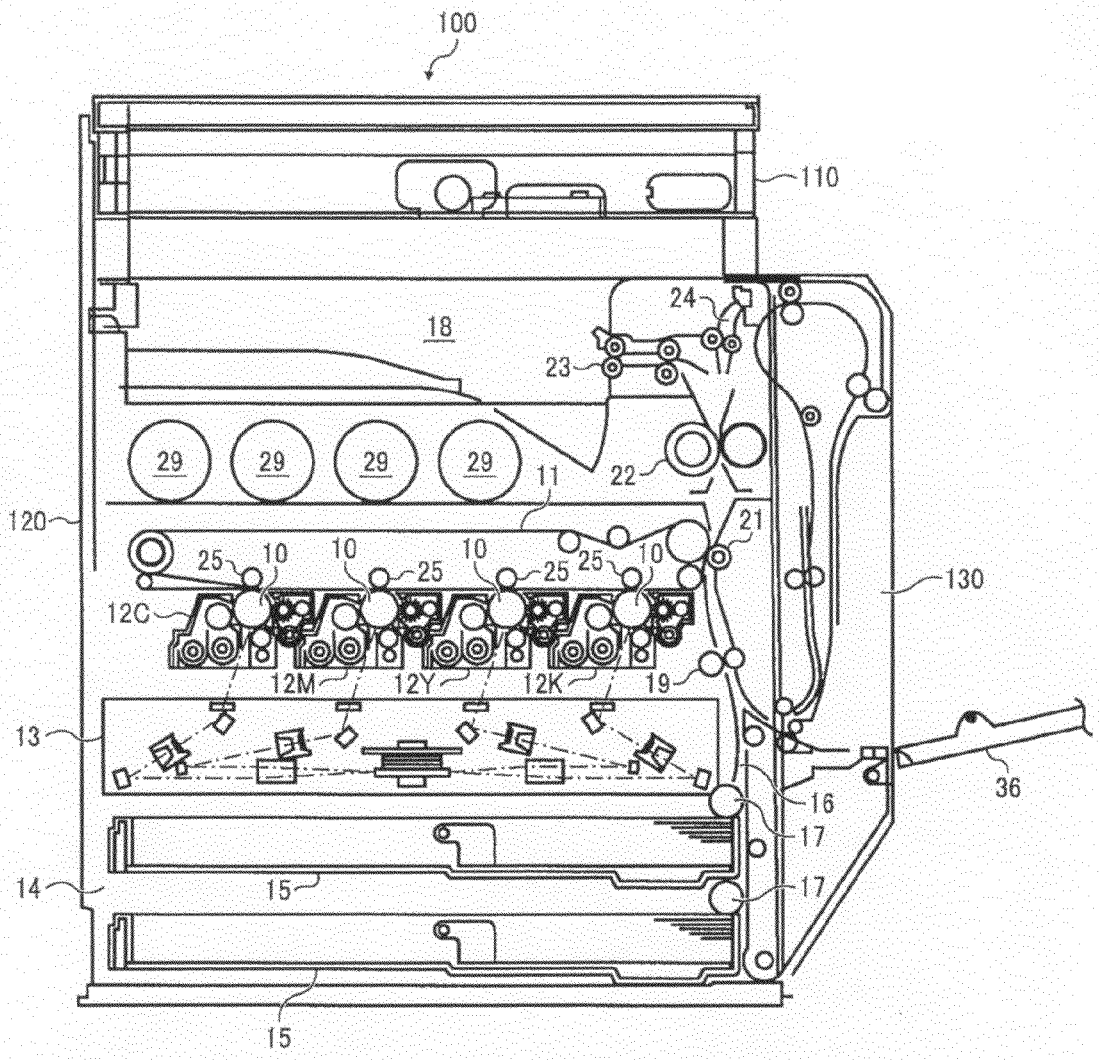
FIG. 1 illustrates an exemplary image forming apparatus of a full color copier including a fixing device according to one embodiment of the present invention.

Referring now to the drawing, wherein like reference numerals designate identical or corresponding parts throughout several views in particular in FIG. 1, an outline of a full color copier as an example of an image forming apparatus including a fixing device according to the present invention is described. As shown, an image forming apparatus 100 includes an image reading device 110 at an upper side of an apparatus body 120. The image forming apparatus also includes printer and facsimile functions beside the copier function. A duplex unit 130 is attached to a right side surface of the apparatus body 120.

In the apparatus body 120, four process cartridges 12C to 12K, an endless intermediate transfer belt 11, a secondary transfer roller 21, and plural toner bottles 29 for supplying mono color toner to the respective process cartridges are arranged. In the process cartridge 12, there is provided a cleaning device a charging device, and a developing device around a drum state image bearer 10.

The intermediate transfer belt 11 is arranged above a photoconductive member 10 of the image bearer and contacts the photoconductive member 10 through its lower running side in each of the process cartridges. Such an intermediate transfer belt 11 is driven counterclockwise in the drawing by plural rollers and serves as a transfer member, onto which different mono color toner images are transferred from the surface of the photoconductive member 10 and superimposed.

A configuration of each of respective image formation units in which a toner image is formed on the photoconductive member and is transferred onto a intermediate transfer belt 11 is substantially the same and only color of toner is different from each other. The photoconductive member 10 is driven rotated clockwise in FIG. 1 and is charged in a prescribed polarity by the charge device that receives a bias of a charge voltage.

The process cartridges 12C to 12K are arranged in tandem. An optical writing device 13 is arranged below the thus arranged process cartridges 12C to 12K. A laser beam emitted from the optical writing device 13 is modulated and reaches the photoconductive member 10 having been subjected to a charge process, whereby a latent image is formed on the photoconductive member 10. The latent image is then developed by the developing device, so that a mono color toner image to be superimposed with the other color toner images is formed.

A primary transfer roller 25 is arranged opposing the photoconductive member 10 via the intermediate transfer belt 11. Due to the bias of the transfer voltage to the primary transfer roller 25, the toner image on the photo conductive member 10 is transferred onto the intermediate transfer belt 11 as a primary transfer.

Below the optical writing device 13, there is provided a sheet feeding device 14 having two steps of sheet cassettes 15 each accommodates printing mediums, such as transfer sheets, etc. The sheets in the respective sheet cassettes 15 are launched one by one by a sheet-feeding roller 17, and are fed along a sheet conveyance path 16.

The sheet conveyance path 16 upwardly extends in the right side of the image forming apparatus body and leads to an inner sheet ejection section 18 formed between the upper surface of the apparatus body and the image reading device 110. On the sheet conveyance path 16, there are subsequently provided a registration roller, a secondary transfer device 21, a fixing device 22, and a sheet ejection device 23 including a pair of sheet ejection rollers. In the upstream of the registration roller 19, there is provided a sheet feeding path that feeds a sheet from either the duplex unit 130 again or a manual sheet feeding section 36 across the duplex unit 130 and joins the sheet conveyance path 16. Further, in the downstream of the fixing device 22, there is provided a sheet re-feeding path 24 branching off to the duplex unit 130.

When a copy is made, the image-reading device 110 reads an original document and the exposure device 13 writes the information. Respective toner images of different mono colors are then formed on the image bearers by the image formation devices 12C to 12K. The toner images are then transferred onto the intermediate transfer belt 11 one by one by the primary transfer device 25 to form a color image thereon.

On the other hand, one of the sheet feeding rollers 17 is selectively rotated and a sheet is launched from either the corresponding sheet cassette 15 or the manual sheet-feeding device 36 onto the sheet conveyance path 16. The sheet is then conveyed through the sheet conveyance path 16 and is launched into a secondary transfer position in synchronism with the color image carried on the intermediate transfer belt 11 from the registration roller 19, whereby the color image is appropriately transferred onto the sheet by the secondary transfer device 21. The sheet after the image transfer is subjected to an image fixing process at the fixing device 22 and is ejected and stacked on the inner sheet ejection section 18 by the sheet ejection device 23.

When an image is also formed on the backside surface, the sheet enters the sheet re-feeding path 24 and is reversed by the duplex unit 130. The sheet is then fed again via the sheet re-feeding path and receives a color image separately formed on the intermediate transfer belt 11 as a secondary transfer. The sheet is then subjected to a fixing process of the fixing device 22 and is ejected onto the inner sheet ejection section 18 by the sheet ejection device 23.

Figure 2:
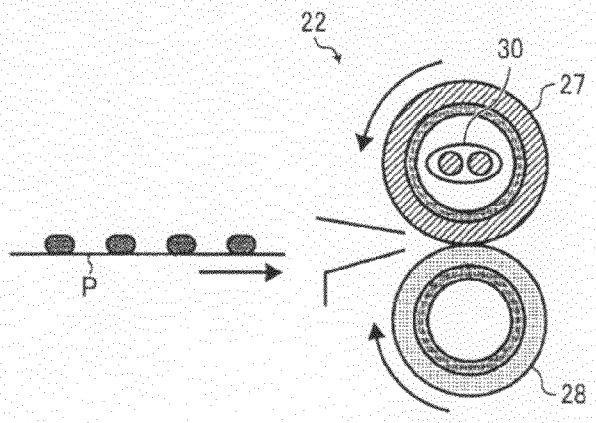
FIG. 2 is a cross sectional view typically illustrating an exemplary configuration of the fixing device.

An exemplary configuration of the fixing device 22 is now described with reference to FIG. 2. As shown, the fixing device 22 includes a fixing roller 27 and a pressurizing roller 28. One of the rotary shafts of these rollers 27 and 28 is secured and the other one is movably supported therefrom, so that the other roller is separable from the roller. Further, one of the rollers 27 and 28 is biased by a spring, not shown, to the other, whereby a fixing nip is created therebetween.

Figure 3:
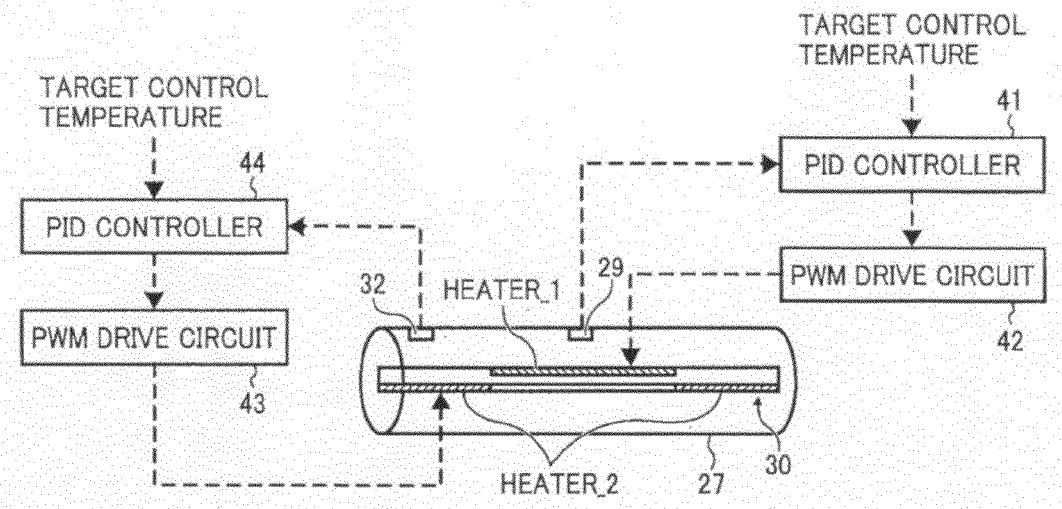
FIG. 3 is a chart illustrating an exemplary manner of controlling a fixing heater.

As shown in FIG. 3, the fixing roller 27 includes a fixing heater 30 having a first heater 1 for heating the central section of the fixing roller and a second heater 2 for heating both ends thereof. Further, there is provided a temperature detection system having a central temperature detection device 29 for detecting temperature of the central section of the fixing roller 27 in the shaft direction and an end temperature detection device 32 for detecting and an end thereof.

Now, an exemplary manner of controlling the fixing heater 30 is described. Initially, a method of controlling the first heater 1 is described. Based on a difference between a target control temperature previously designated and temperature detected at the central section of the fixing roller by the central temperature detection device 29, the PID controller 41 executes calculation. The calculation result represents a ratio (i.e., DUTY_1) of power distribution to the heater 1 per hour (i.e. a control cycle). The heater-1 is turned on by a PWM drive circuit 42 based on the calculated DUTY_1. For example, a ratio of biasing a rating AC voltage to the both ends of the heater-1 per hour is controlled.

Now, a sequence of calculating the DUTY_1 using PID calculation formulas is briefly described. Specifically, a formula 3 is obtained by converting the below described formula 2 as a fundamental PID formula into a digital type, and is utilized as described below, wherein Kp represents proportional gain, TI represents an integral time period, $T_D$ represents a differential time period, e1 (t) represents a difference between a target control temperature and that at the center of a fixing roller 27 (=r1(t)−y1(t)), r1(t) represents a target control temperature, y1 (t) represents a temperature of a central section of a fixing member, and T represents a control cycle.

$$\text{DUTY_1}=Kp(e1(t)+1/T_I\times\int_0^t e1(t)dt+T_D\times de1(t)/dt). \quad \text{Formula 2;}$$

$$\text{DUTY_1}'=Kp[(e1(k)+1/T_I\times\Sigma T/2(e1(j-1)+e1(j))+T_D\times(e1(k)-e1(k-1)/T)]. \quad \text{Formula 3;}$$

Values of Kp, TI, and TD are appropriately predetermined. Duty_1 is calculated per control cycle, and a time period of power distribution to the heater 1 is then determined.

Figure 11:
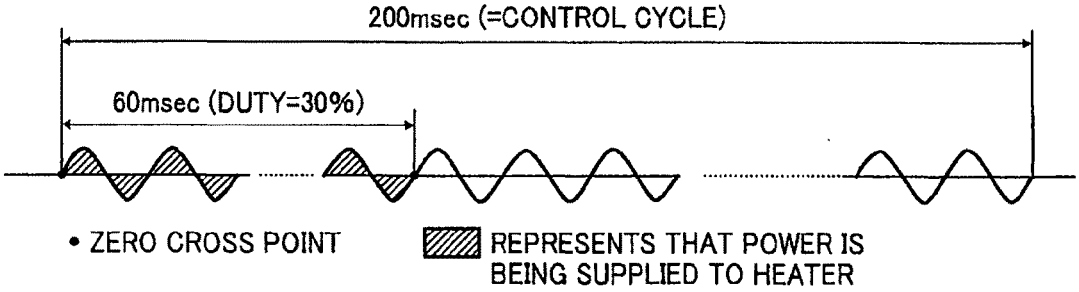
FIG. 11 typically illustrates an exemplary system of power distribution turn on and off at zero cross points.
Figure 12:
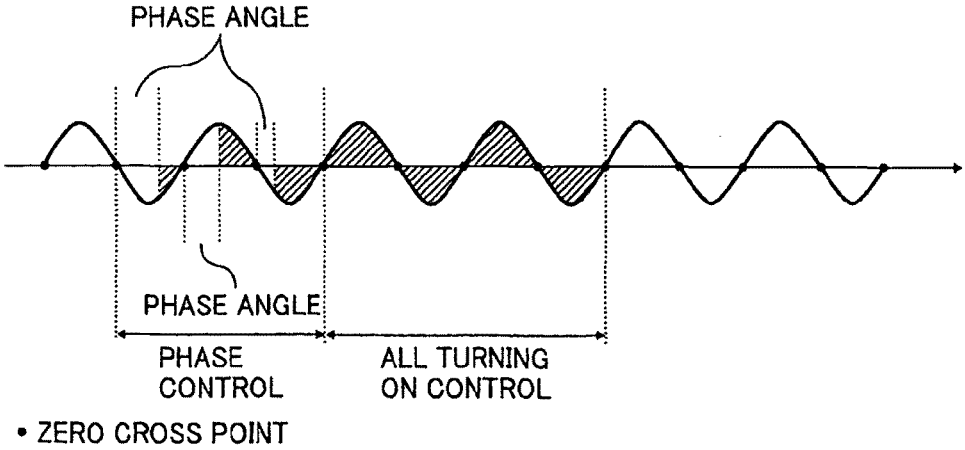
FIG. 12 typically illustrates exemplary fixing controller using a soft start system.
Figure 13:
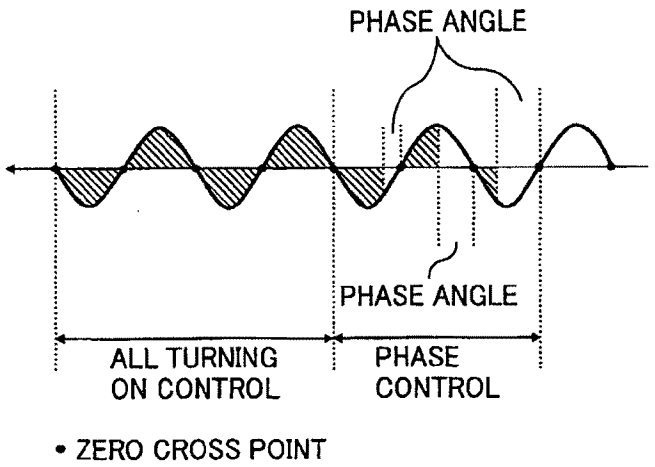
FIG. 13 typically illustrates exemplary fixing control using a soft stop system.
Figure 14:
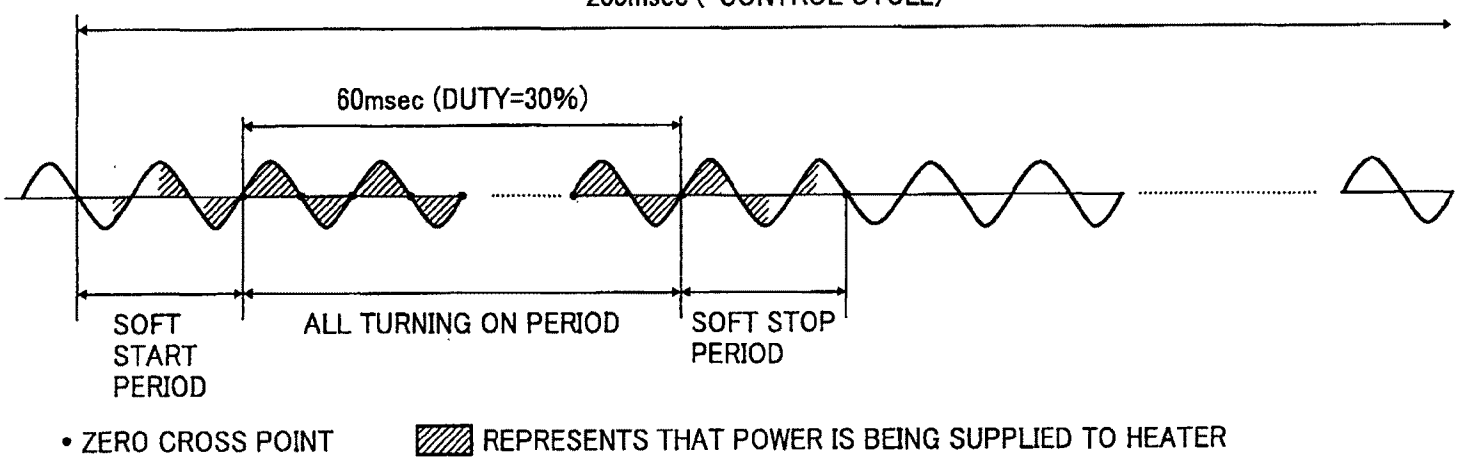
FIG. 14 typically illustrates exemplary power distribution control using soft start and stop systems.
Figure 15:
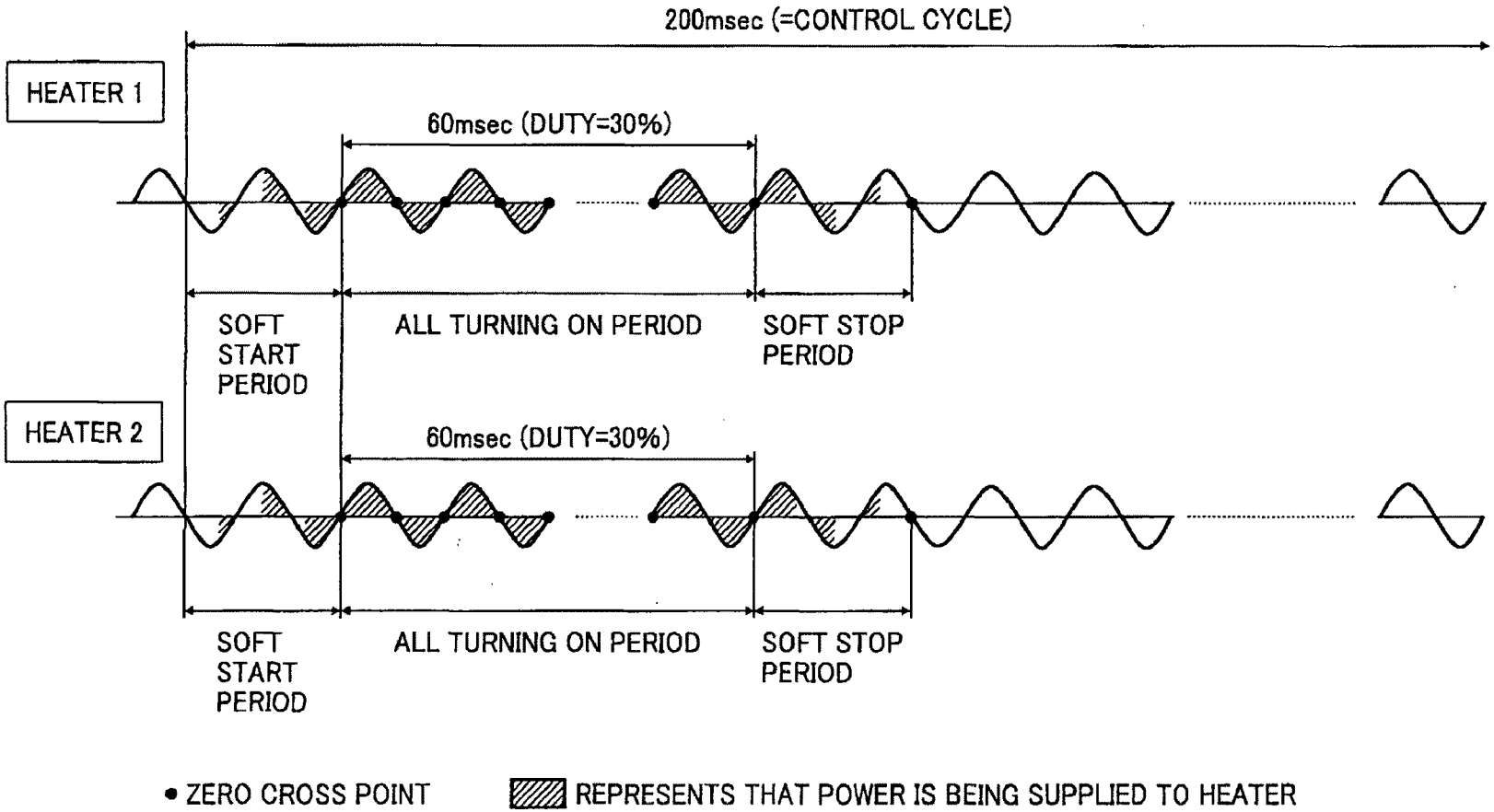
FIG. 15 typically illustrates exemplary control of turning on a pair of heaters using soft start and soft stop systems.
Figure 16:
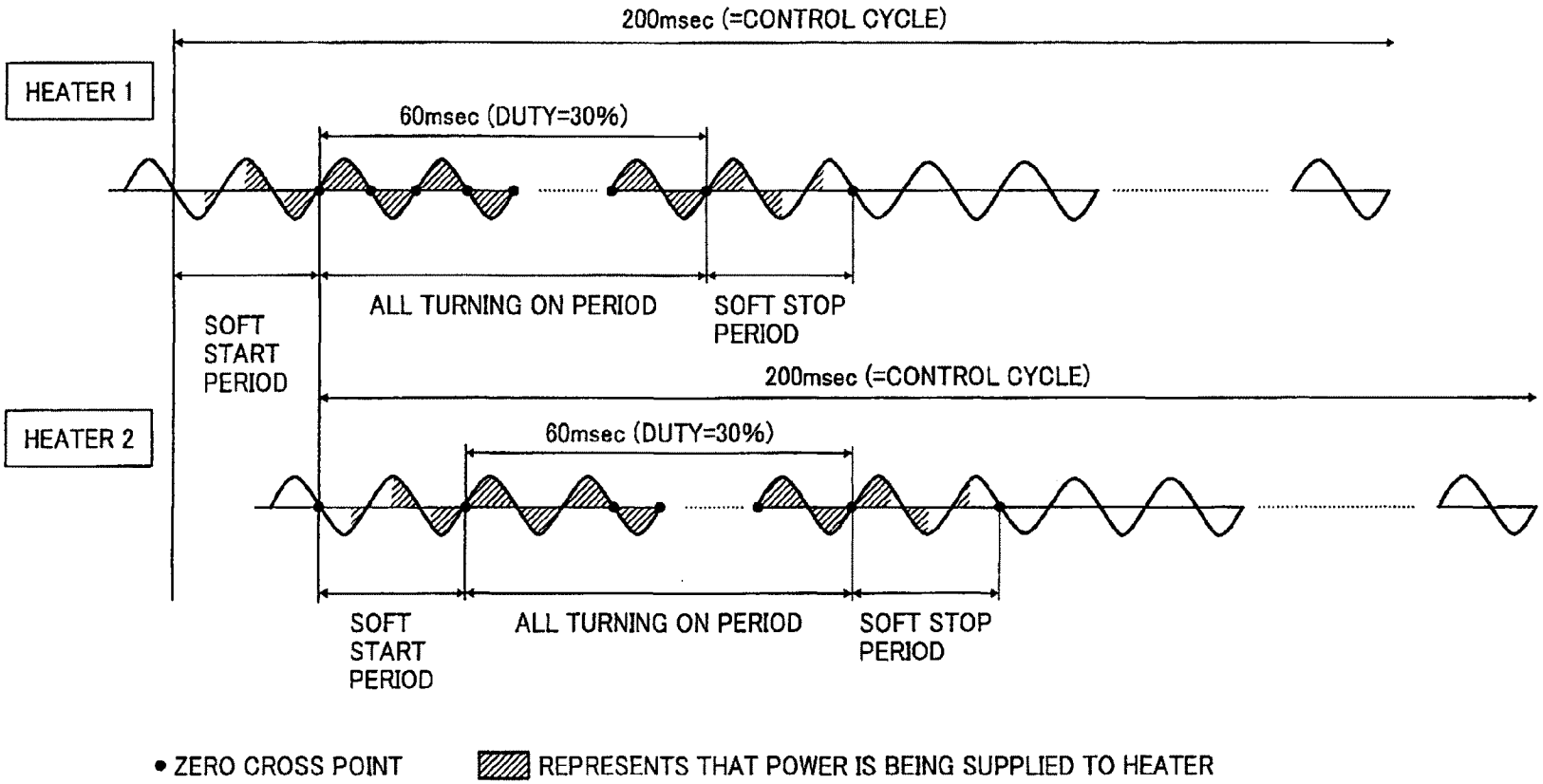
FIG. 16 typically illustrates exemplary fixing control of deviating turning on time of one heater from the other.

For example, when the control cycle is 200 msec, the DUTY_1 calculated by the above-mentioned formula is 30%, power distribution is obtained as shown in FIG. 11. When the above mentioned power distribution is executed based on the DUTY 1 as mentioned above, soft start gradually increasing power distribution time period and soft stop gradually decreasing the power distribution are executed to decrease voltage change generally appearing when power distribution starts and completes, respectively, as shown in FIG. 14.

To control the heater 2, a PID controller 44 similarly executes calculation using the below described formulas 4 and 5 based on a difference between a target control temperature previously designated and temperature detected at the end of the fixing roller by an end temperature detection device 29; wherein e2 (t) represents a difference between a target control temperature and that at an end of the fixing roller 27 (=r2(t)−y2(t)), r2(t) represents a target control temperature, and y2 (t) represents temperature of an end of a fixing roller.

$$\text{DUTY_2}=Kp(e2(t)+1/T_I\times\int_0^t e2(t)dt+T_D\times de2(t)/dt). \quad \text{Formula 4;}$$

$$\text{DUTY_2}'=Kp[(e2(k)+1/T_I\times\Sigma T/2(e2(j-1)+e2(j))+T_D\times(e2(k)-e2(k-1)/T)). \quad \text{Formula 5;}$$

Figure 4:
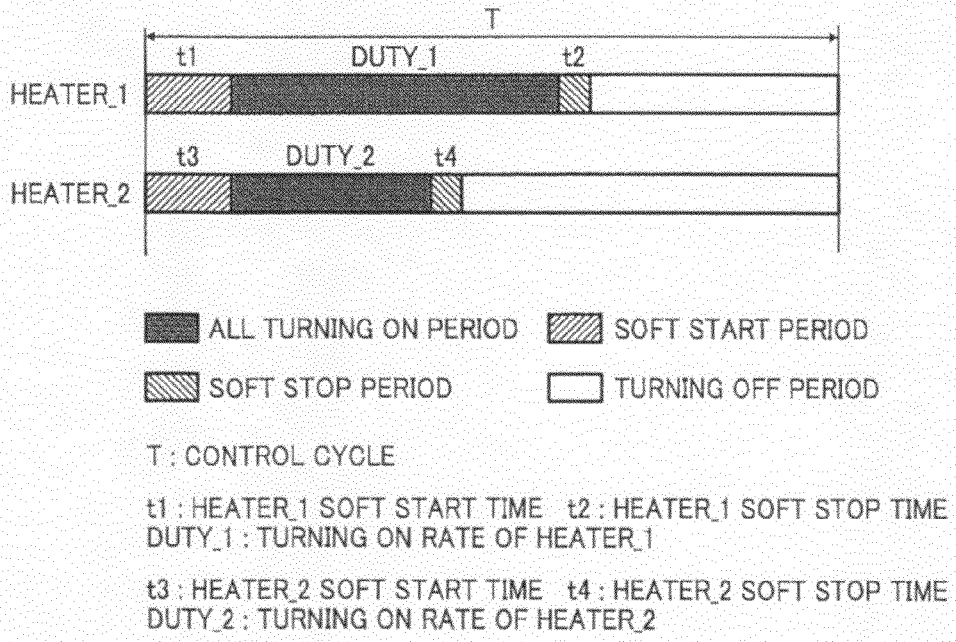

Then, the heater 2 is turned on via a PWM drive circuit 43. Similarly, soft start and stop time periods are provided to gradually change turning on time period as typically shown in FIG. 4.

As mentioned above, when the soft start and stop time periods for the heaters overlap with each other, high harmonic wave current increases. Then, a turn on start time for the heater 2 is deviated from that of the heater 1 as mentioned below with reference to FIG. 5. Specifically, three kinds of patterns are possible not to overlap the soft start and stop time period with other's.

The pattern A is a serial type, in which one of heaters starts turning on when the other heater completes the soft stop and is turned off. Since the heaters 1 and 2 do not simultaneously turn on, it most advantageously suppress the flicker and high harmonic wave current.

The pattern B is an insertion type, in which the other heater turns on between soft start and stop periods of the other heater. This pattern can be adopted when a turn on rate of a heater is relatively small in comparison with the other heater.

The pattern C starts the soft start for a heater when the soft start time period for the other heater has elapsed, and after the soft stop for the other heater starts when the soft stop for the heater completes.

To turn on a heater using one of the above-mentioned three patterns A to C; both of the DUTY_1 and the DUTY_2 necessarily meet the following conditions. For the pattern A, the following relation should be met:

$$t1+t2+t3+t4+\text{DUTY_1}+\text{DUTY_2}<T \quad (6)$$

For the pattern B, the following relations should be met:

$$\text{DUTY_1}>t3+t4+\text{DUTY_2} \quad (7), \text{ and}$$

$$t1+t2+\text{DUTY_1}<T \quad (8).$$

For the pattern C, the following relations should be met:

$$t1+t2+t4+\text{DUTY_1}<T \quad (9),$$

$$\text{DUTY_1}>t3 \quad (10), \text{ and}$$

$$\text{DUTY_2}>t2 \quad (11).$$

Figure 6:
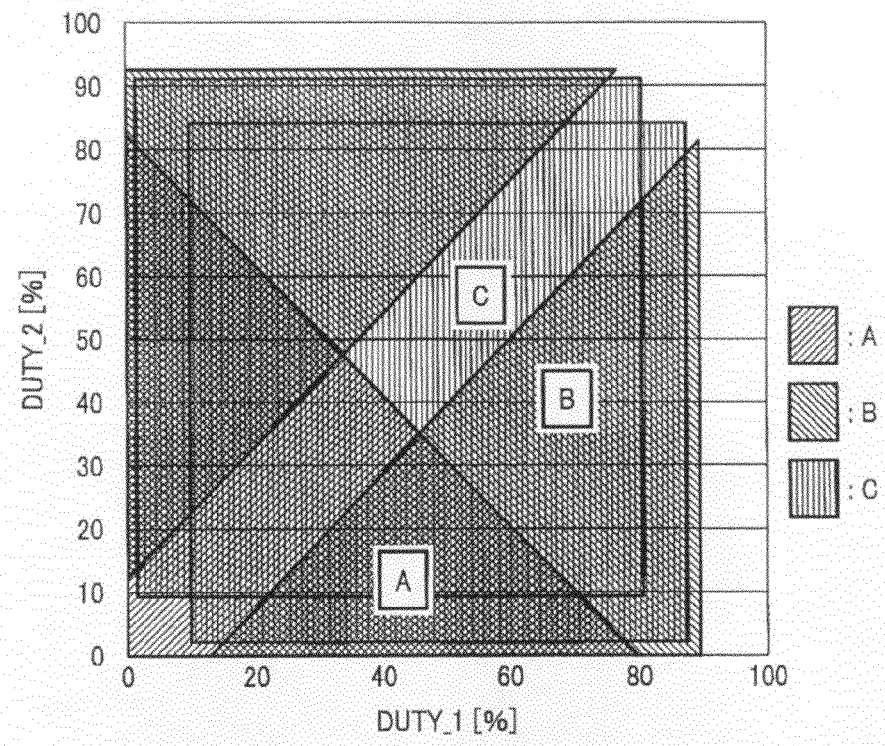
FIG. 6 is a graph illustrating the three patterns of FIG. 5.

When values listed on the table 1 are substituted to the parameters of t1 to t4 and T of the above-mentioned formulas, graphs are obtained as shown in FIG. 6.

TABLE 1

| Control cycle | T | Time (ms) 200 |
|---|---|---|
| Soft Start | t1 | 15 |
| Soft Stop | t2 | 5 |
| Soft Start | t3 | 15 |
| Soft Stop | t4 | 5 |

FIG. 6 illustrates one of the patterns A to C to be referred to and selectively employed to prevent overlap of the soft starts and stops of heaters with each other when these DUTY_1 and DUTY_2 are determined by the PID controller.

For example, when the DUTY_1 is 20% and DUTY_2 is 30%, a heater can be turned on by the pattern A. When the DUTY_1 is 30% and DUTY_2 is 80%, a heater can be turned on by the pattern B. When these DUTY_1 and DUTY_2 are commonly 60%, a heater can be turned on by the pattern C. In this way, the soft start and stop zones of the heaters are enabled not to overlap with each other.

In general, when the control cycle is not less than 200 msec and each of heater ratings is not more than 1200 W, soft start and stop of the heaters can be controlled by one of the patterns A to C when the Duties of the heaters are not more than 80%.

As mentioned heretofore, by selectively employing one of the patters A to C to deviate a time of turning on the heater based on the DUTY thereof calculated by the PID controller, the soft start and stop zones of the heaters are enabled not to overlap with each other. As a result, high harmonic current can be suppressed.

Figure 7:
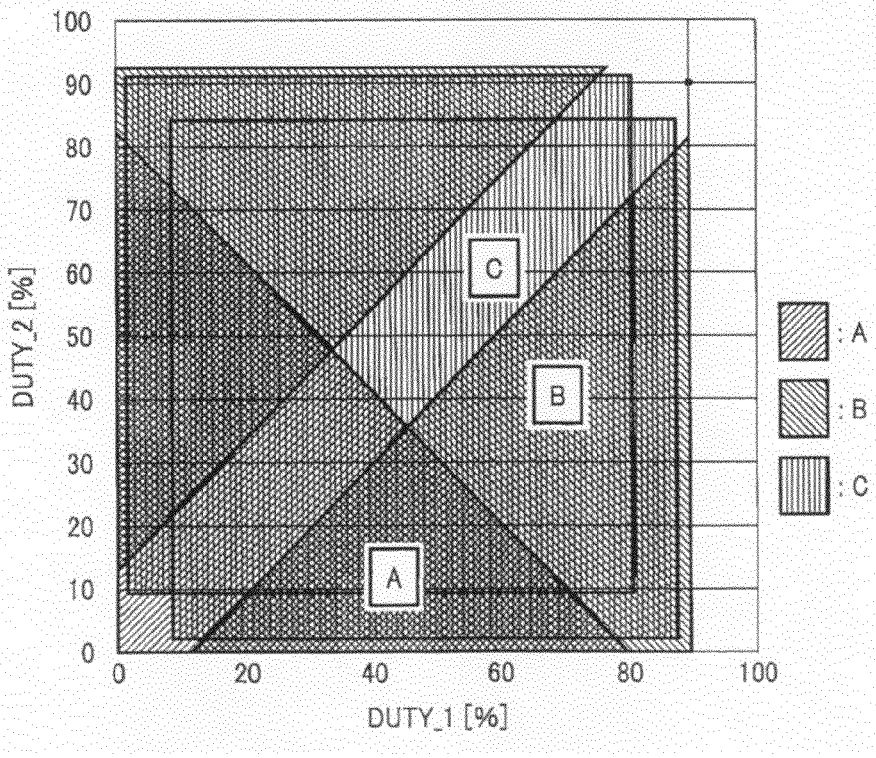
FIG. 7 illustrates a region excluded from the three patterns of FIG. 5.

However, when this method is used, there exists a region excluded from the patterns A to C, such as when the DUTY_1 and the DUTY_2 are 90% as indicated by a dot mark in FIG. 7.

In such a situation, conversion to the patterns A to C is executed by a prescribed method so that the soft starts and stops are not overlapped with each other. However, a DUTY calculated by a PID controller is preferably used as is.

Then, according to one embodiment of the present invention, the soft start and stop zones of the heaters do not overlap with each other even in such a situation impossible to use the patterns A to C. Now, exemplary countermeasures are herein below described from first to third embodiments related to control of the soft start time period, and a fourth embodiment related to that of the soft stop, as well as fifth to seventh examples employing a secondary power supply device.

Now, a first embodiment is described. The first embodiment features usage of a DUTY of the last control cycle. Originally, a sharp voltage change to be suppressed by the soft start is prominent when filament temperature of a heater and a resistance thereof are low. However, a general halogen heater does not include a tool for directly measuring temperature of the filament. Then, as an alternative, the DUTY of the last cycle is utilized.

Figure 8:
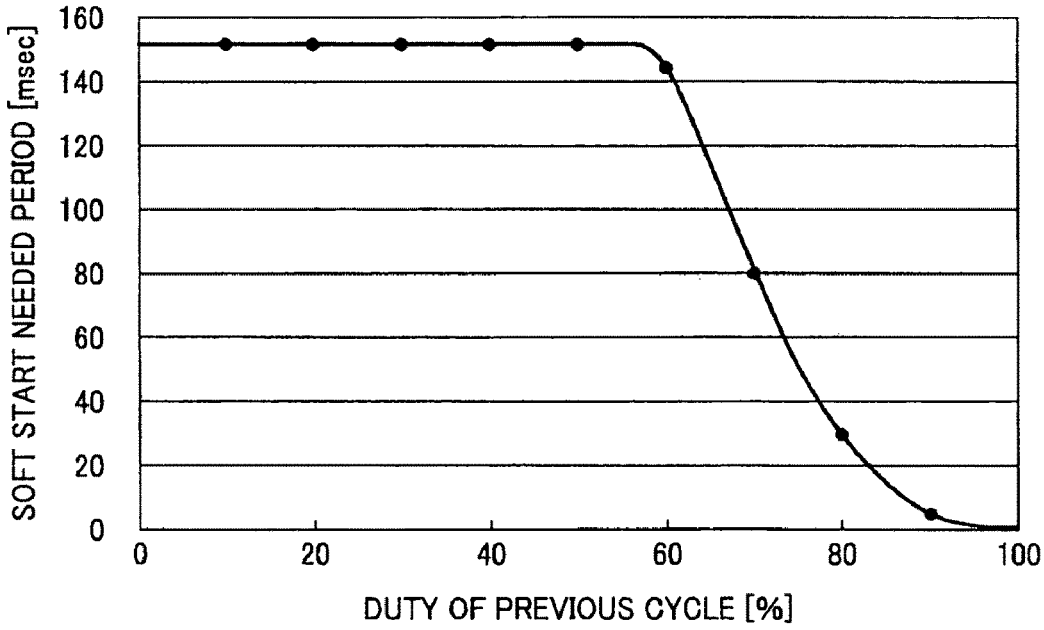
FIG. 8 is a graph illustrating an exemplary relation between a DUTY for a previous cycle and a soft start time period needed in the cycle.
Figure 10:
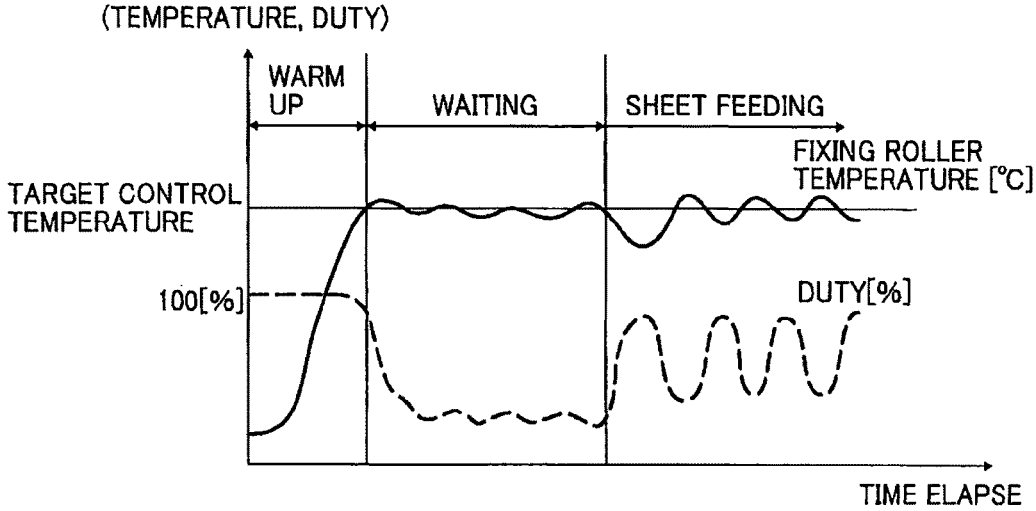
FIG. 10 illustrates an exemplary control for stabilizing fixing temperature at around a target temperature.

A relation between Duties of the last cycle and a soft start time period needed by the current cycle is represented in FIG. 8. As understood therefrom, when the Duty of the last cycle is high, since the filament temperature does not really decrease, the soft start time period can be decreased in the current cycle. When the patterns A to C can not be referred to, such as when the DUTY_1 and the DUTY_2 are 90%, the soft start time period is decreased by using such a secondary performance. Specifically, the soft start time period of each of the heaters is decreased when the previous DUTY is almost a high level. As a result, the soft starts and stops of heaters are not overlapped with each other.

For example, as shown in FIG. 8, when a DUTY of the last cycle is 90%, the soft start time period can be decreased to not more than 10 msec. When the DUTY of the last cycle is about 95%, the soft start time period can be almost omitted without any problem. Further, when the DUTY of the last cycle is from 80% to 90%, the soft start time period can be decreased from 30 to 10 msec. By either decreasing or omitting the soft start time period in this way, the soft start and stop time periods can be avoided from being overlapped with each other in the plural heaters (e.g. the heaters 1 and 2).

Now, a second embodiment is described. The second embodiment utilizes a time period elapsed after the last turning off of a heater instead of the DUTY of the last cycle as a secondary detection tool for detecting temperature of the filament of the heater.

Specifically, since temperature of a filament of a fixing heater 30 is not really low when the elapsing time period after the last turning off of the fixing heater 30 is shorter than a prescribed level, the soft start time period can be decreased. Specifically, when it is impossible to apply the above-mentioned A to C patterns, the elapsing time period is referred to. When the elapsing time period is less than the prescribed level, soft start time periods for the heater 1 and 2 are decreased or omitted. As a result, the soft start and stop time periods are not overlapped with each other.

Recognition of the elapsing time period all the time sometimes increases calculation load on the apparatus in comparison with the DUTY of the last cycle. Thus, one of them is appropriately selected in view of the load in accordance with a system of the apparatus.

Now, a third embodiment is described. The third embodiment utilizes temperature of a fixing member at a current cycle as a secondary detection tool indicating temperature of a filament of a heater.

Specifically, since the temperature of the filament is not really low when the temperature of the fixing member (i.e. the fixing roller 27) is higher than a prescribed level, the soft start time period can be decreased. Specifically, when it is impossible to refer to the above-mentioned A to C patterns by utilizing the secondary performance, the temperature of the fixing roller 27, detected by the central and end detection devices 29 and 32, is referred to, and when it is higher than the prescribed level, soft start time periods for the heaters 1 and 2 are decreased or omitted.

As a result, the soft start and stop time periods are not overlapped with each other.

Now, a fourth embodiment is described. The fourth embodiment decreases the soft stop time period even when the above-mentioned patterns A to C cannot be referred to.

Specifically, the soft start control is executed to suppress sharp change of power appearing when it is supplied to a heater or when a filament resistance changes. Whereas the soft stop control is executed to suppress only a change of power caused when the power having being supplied to the heater disappears. Thus, the soft stop is not necessarily executed by each of heaters and can alternatively be executed by another heater that consumes substantially the same power. Because, it is sufficient if the fixing device as a whole can avoid a sharp change of a voltage. Thus, when the soft start and stop controls overlap with each other, the soft stop control is not executed. As a result, even when the above-mentioned patterns A to C cannot be referred to, the soft starts and stops of the heaters 1 and 2 do not overlap with each other.

Now, an exemplary usage manner using a power-supplying device other than the commercial power supply is described. A secondary power-supplying device is employed to avoid the commercial power supply from being influenced by a sharp change of an electric resistance of a heater that necessitates the soft start control.

Figure 5:
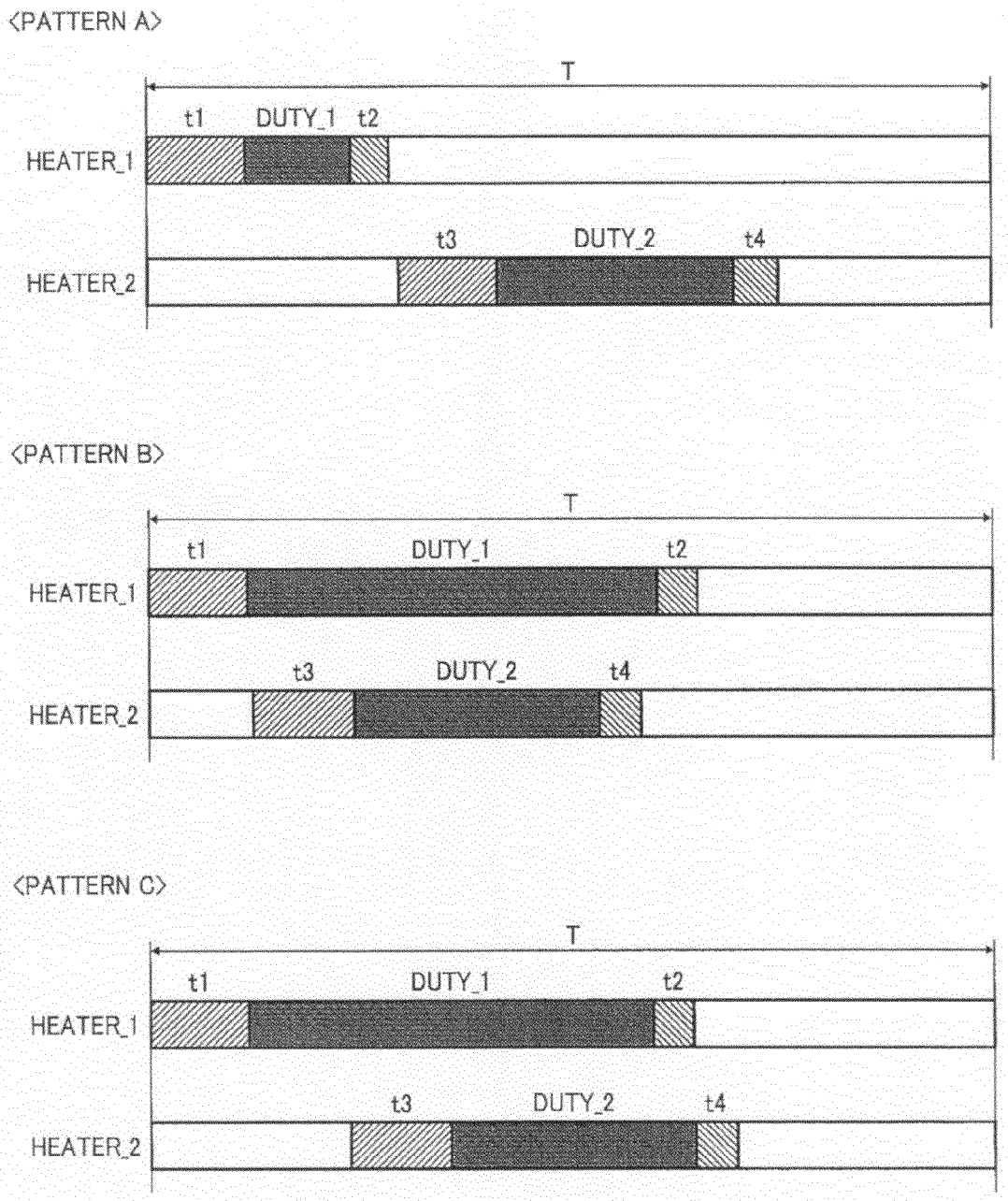
FIG. 5 is a chart typically illustrating three patterns in which soft start and stop time periods for the pair of heaters are not overlapped with each other.

As far as it is not primarily connected to the commercial power supply for the above-mentioned purpose, an auxiliary power-supplying device storing power supplied from the commercial power supply can be used. By using the secondary power-supplying device, soft start control can be decreased or omitted in a heater. As a result, the region of the patterns A to C of FIG. 6 can be extended. Now, specific examples are described. However, an image forming apparatus, a fixing device, and duty control for a fixing heater by means of a PID controller executing the below described embodiments with reference to FIGS. 5 to 7 are substantially the same as the above-mentioned various embodiments. Thus, the same description is hereinafter omitted.

Now, an exemplary circuit of a power supply according to a fifth embodiment is descried with reference to FIG. 9. As shown, a commercial power supply 200 supplies direct current power and heats a fixing heater HT1 via a reply 206 as a switching element, a rectifier 211, and a step-down circuit 207. On the other hand, a storage element 202 included in an auxiliary power supply 220 is supplied by the commercial power supply 200 with power and is charged. The storage element 202 then supplies the direct current power and heats the fixing heater HT1 via the step-down circuit 207.

In the auxiliary power supply 220, there is provided a charge/discharge control section 203 to control charging and discharging. As the storage element 202, an electric two-layer capacitor, a condenser, and a primary battery or the like are used. The charge/discharge control section 203 includes a charging device (e.g. included in the charge/discharge control section 203) that causes the storage element 202 to receive and be charged with power supplied from the commercial power supply 200. Specifically, the charge/discharge control section 203 controls discharging to the step down circuit 207 via the switching element, such as the relay 204, etc.

Thus, since the auxiliary power supply 220 is connected to the commercial power supply via the storage element, the commercial power supply is not directly affected by the current changes caused due to sharp change of resistance in a heater, the soft start time period can be decreased as a result and is advantageous to the flicker Now, a sixth embodiment is described, in which a secondary power supplying device is used during an initial phase when a heater is turned on. A storage capacity of the auxiliary power supply 220 is defined by the storage element 202. Specifically, if the storage amount is sufficiently large, the auxiliary power supply can always be used. However, when the storage capacity of the storage element 202 increases, the size increases, thereby parts become expensive. Thus, the parts are expected as small as possible. When a usage situation is limited, the auxiliary power supply is most efficiently used during an initial phase when a heater is turned on and a change of resistance is largest.

An exemplary configuration of fifth and sixth embodiments is now described with reference to FIG. 9. As shown, the fixing device 122 includes a fixing roller (a heating roller) 301 having a heater HT1, and a pressurizing roller having a heater HT2 pressure contacting the fixing roller 301. The heaters HT1 and HT2 each includes a heat generation section extending over a sheet passage region. However, a fixing device 22 can be used instead of the fixing device 122.

Now, a seventh embodiment is described, in which a heater is tuned on by a direct current power supply instead of the auxiliary power supply. Specifically, even not shown, the commercial power supply is converted into a direct current and a direct current power supply turns on each of the heaters (e.g. heaters 1 and 2 built in the fixing roller, or heaters HT1 and HT2 built in the respective fixing and pressurizing rollers). Since turning on the heater by means of the direct current power supply is hardly affected by a change of resistance, the soft start time period can be more effectively decreased than a turning on method using alternating current. Thus, a change of a voltage in the commercial power supply line and generation of a flicker phenomenon can be avoided.

In the above-mentioned various embodiments, the PID controller is used to calculate a power distribution time period (i.e. DUTY) for a heater. However, a similar controller, such as an I-PD controller, a PI-D controller, etc., can be used to stabilize temperature.

Further, a fixing device and a controller or the like used to calculate DUTY are not limited to the above-mentioned devices, and various devices can be appropriately used. The fixing member is not limited to the above-mentioned fixing roller and an endless belt type can be used. Heat generation sections of plural heaters can be appropriately designated. A position for arranging a temperature detection device can be appropriately designated. Further, the control cycles of the soft start and stops are not limited to the above mentioned devices, and can be appropriately designated.

Each of sections of image forming apparatus can be optionally designed. An arrangement order of the respective color image formation units in the tandem system can be optional. It is not limited to the tandem system, but plural developing devices can be arranged around a photoconductive member. Otherwise, a revolver type-developing device can be employed. Further, the present invention can also be applied to a full color machine employing three mono color toner, a multi color machine employing dual mono color toner, and a monochrome machine. It is not limited to the multi color machine, but also a copier, a facsimile, and a printer can be employed as an image forming apparatus.

Obviously, numerous additional modifications and variations of the present invention are possible in light of the above teachings. It is therefore to be understood that within the scope of the appended claims, the present invention may be practiced otherwise than as specifically described herein.

ADVANTAGE

According to one embodiment of the present invention, since the soft start time period is adjusted by either decreasing or canceling thereof not to overlap with the soft stop time period executed for the other heaters, a high harmonic current generally appearing along with the voltage change or the phase control can be suppressed in the commercial power supply line. Further, such overlapping can widely be suppressed in the DUTY region, thereby a margin meeting a high harmonic current standard can be broadened.

What is claimed is:

1. A fixing control device for controlling temperature of a fixing device at a prescribed level, said fixing device including a pressurizing member for applying pressure, a fixing member for fixing a toner image carried on a printing medium with the pressure applied by the pressurizing member, and a heat source having at least two heater elements for heating at least one of the pressurizing member and the fixing member, said fixing control device comprising:

a power distribution controller configured to adjust a power distribution time period when power is distributed to the at least two heater elements per control cycle;

a turn on time determining member configured to determine a time when each of the at least two heater elements is turned on based on a duty ratio between the power distribution time period and the control cycle; and a soft operation controller configured to either gradually start or stop heating each of the at least two heater elements during a soft start or stop period, respectively, wherein said soft start or stop time period of one of the at least two heater elements is decreased not to overlap with the soft start or stop time period of the other one of the at least two heater elements, and said soft stop time period is decreased when the soft start time period of one of the at least two heater elements overlaps with the soft stop time period of the other one of the at least two heater elements.

2. The fixing control device as claimed in claim 1, wherein said soft start time period is determined based on the duty ratio of one of the at least two heater elements to be heated, said duty ratio being calculated in the last control cycle.

3. The fixing control device as claimed in claim 1, wherein said soft start time period is determined based on a time period elapsed after one of the at least two heater elements to be heated is lastly turned off.

4. The fixing control device as claimed in claim 1, wherein said soft start time period is determined based on temperature of the heat source.

5. The fixing control device as claimed in claim 1, wherein said power is distributed from a secondary power supply other than a commercial power supply.

6. The fixing control device as claimed in claim 5, wherein said secondary power supply is supplied with the power from the commercial power supply.

7. The fixing control device as claimed in claim 6, wherein said secondary power supply is supplied with the power at a prescribed initial stage when one of the at least two heater elements is turned on.

8. The fixing control device as claimed in claim 5, wherein said secondary power supply supplies the power to the at least two heater elements after converting the power supplied from the commercial power supply into a direct current.

9. The fixing control device as claimed in claim 8, wherein said at least two heater elements are arranged corresponding to sizes of the printing mediums, said at least two heater elements being installed in the fixing member.

10. A fixing device including the fixing control device as claimed in claim 9.

11. An image forming apparatus including the fixing device as claimed in claim 10.

12. A fixing control device for controlling temperature of a fixing device at a prescribed level, said fixing device including a pressurizing member for applying pressure, a fixing member for fixing a toner image carried on a printing medium with the pressure applied by the pressurizing member, and a heat source having at least two heater elements for heating at least one of the pressurizing member and the fixing member, said fixing control device comprising:

a power distribution controller configured to adjust a power distribution time period when power is distributed to the at least two heater elements per control cycle;

a turn on time determining member configured to determine a time when each of the at least two heater elements is turned on based on a duty ratio between the power distribution time period and the control cycle; and a soft operation controller configured to either gradually start or stop heating each of the at least two heater elements during a soft start or stop period, respectively, wherein said soft start or stop time period of one of the at least two heater elements is decreased not to overlap with the soft start or stop time period of the other one of the at least two heater elements, and said soft start time period is determined based on the duty ratio of one of the at least two heater elements to be heated, said duty ratio being calculated in the last control cycle.

13. The fixing control device as claimed in claim 12, wherein said soft start time period is determined based on temperature of the heat source.

14. The fixing control device as claimed in claim 12, wherein said power is distributed from a secondary power supply other than a commercial power supply.

15. The fixing control device as claimed in claim 14, wherein said secondary power supply supplies the power to the at least two heater elements after converting the power supplied from the commercial power supply into a direct current.

16. A fixing control device for controlling temperature of a fixing device at a prescribed level, said fixing device including a pressurizing member for applying pressure, a fixing member for fixing a toner image carried on a printing medium with the pressure applied by the pressurizing member, and a heat source having at least two heater elements for heating at least one of the pressurizing member and the fixing member, said fixing control device comprising:

a power distribution controller configured to adjust a power distribution time period when power is distributed to the at least two heater elements per control cycle;

a turn on time determining member configured to determine a time when each of the at least two heater elements is turned on based on a duty ratio between the power distribution time period and the control cycle; and a soft operation controller configured to either gradually start or stop heating each of the at least two heater elements during a soft start or stop period, respectively, wherein said soft start or stop time period of one of the at least two heater elements is decreased not to overlap with the soft start or stop time period of the other one of the at least two heater elements, and said soft start time period is determined based on a time period elapsed after one of the at least two heater elements to be heated is lastly turned off.

17. The fixing control device as claimed in claim 16, wherein said soft start time period is determined based on temperature of the heat source.

18. The fixing control device as claimed in claim 16, wherein said power is distributed from a secondary power supply other than a commercial power supply.

19. The fixing control device as claimed in claim 18, wherein said secondary power supply supplies the power to the at least two heater elements after converting the power supplied from the commercial power supply into a direct current.

* * * * *